United States Patent [19]

Hellmann et al.

[11] Patent Number: 4,800,831

[45] Date of Patent: Jan. 31, 1989

[54] ICE BREAKER

[75] Inventors: Jens H. Hellmann; Karl-Heinz Rupp, both of Hamburg; Günter Varges, Emden, all of Fed. Rep. of Germany

[73] Assignee: Thyssen Nordseewerke GmbH

[21] Appl. No.: 912,966

[22] Filed: Sep. 29, 1986

[30] Foreign Application Priority Data

Oct. 2, 1985 [DE] Fed. Rep. of Germany ..... 3535091

[51] Int. Cl.[4] ..... B63B 21/56

[52] U.S. Cl. ..... 114/40; 440/33

[58] Field of Search ..... 114/40–42; 440/33, 34, 36

[56] References Cited

U.S. PATENT DOCUMENTS

| | | | |
|---|---|---|---|
| 719,907 | 2/1903 | Tone | 440/34 |
| 1,034,022 | 7/1912 | Meyer | 440/34 |
| 2,259,226 | 10/1941 | Kuhne | 440/34 |
| 3,656,449 | 4/1972 | Mead | 440/36 |
| 3,762,354 | 10/1973 | Waas | 114/41 |
| 3,768,427 | 10/1973 | Stephens | 114/41 |
| 3,886,882 | 6/1975 | Thornburg et al. | 114/40 |
| 4,033,056 | 7/1977 | Demmers | 440/36 |
| 4,434,741 | 3/1984 | Wright et al. | 114/40 |
| 4,597,350 | 7/1986 | Mott | 114/40 |

FOREIGN PATENT DOCUMENTS 59-179483 10/1984 Japan ..... 440/36

*Primary Examiner*—Joseph F. Peters, Jr.
*Assistant Examiner*—Edwin L. Swinehart
*Attorney, Agent, or Firm*—Toren, McGeady & Associates

[57] ABSTRACT

Broken ice floes move laterally by the prow of an ice breaker into a position below the unbroken ice cover laterally limit the fairway channel formed and surround the stern of the ship, so that as a result of the increased water speed produced by the propeller thrust deduction the ice is drawn into the propeller, which chops it up, so that increased propeller power is necessary. In addition, the propeller can be damaged by ice floes moved back into the fairway channel. To avoid this, the horizontal propulsion of the ice breaker takes place in propeller-independent manner by jet or rocket engines or by instantaneous or constant propulsion energy-producing force closure of the hull with a mechanical apparatus located on the ocean bed, such as a chain, cable or lowered travelling piles, and a mechanical pushing off or hauling in apparatus being provided on the hull side.

8 Claims, 6 Drawing Sheets

ICE BREAKER

BACKGROUND OF THE INVENTION

The present invention relates to an ice breaker. Various different ice breaker constructions are known. In the case of an ice breaker with self-propulsion, the forward propulsion takes place by means of the propeller or screw. An ice breaker operating in shallow waters has ever increasing difficulties in removing the broken ice with decreasing distance from the ship's bottom to the ocean, sea or river bed and inter alia the broken ice disturbes the supply of water to the propellers.

Ice floes which have become broken and move laterally by the ship's prow under the unbroken ice cover laterally limit the fairway channel formed and surround the stern of the ice breaker in such a way that the ice is drawn into the propellers as a result of the increased water speed produced by the propeller thrust deduction and the ice is chopped by said propellers, so that an increased propeller power is required. With increased propeller thrust deduction further disadvantageous effect occur, namely the ocean bed is washed out by the backwash and is moved to the rear and side if the ocean bed is made from soft material, so that protuberances and depressions form on said bed, which lead to navigational problems, particularly for ships following the ice breaker or in the case of sternway travel of the actual ice breaker. In addition, the propellers can be damaged by the ice flows broken by the prow during forward propulsion and moved back by the thrust deduction into the fairway channel.

SUMMARY OF THE INVENTION

The problem of the present invention is to provide an ice breaker, which can in particular be used in ice-covered shallow waters, especially those having thick ice covers, in which the propulsion of the ship is not brought about by propellers and in which said ship leads to substantially ice flow-free fairway channels, thereby avoiding a floating back of broken flows into the channel.

According to the invention this problem is solved by an ice breaker in that the horizontal propulsion of the ship is independent of this ship screw.

According to a further feature of the invention, the ice breaker is constructed in such a way that the horizontal propulsion of the ship takes place by jet engines, rocket engines or force closure of the hull with mechanical means located on the ocean bed and which instantaneously or constantly provide the propulsion energy for the ship. Examples of such means are constituted by a terminally anchored chain or cable laid along the ocean bed, said chain, cable or the like being guided by means of driven chain gripping wheels, drums, etc provided on the bottom of the hull, or takes place like lowered or lowerable, vertical piles or the like, mechanical pushing off or hauling in means being provided on the hull side.

An ice breaker with such a propulsion means, comprising a so-called travelling pile and mechanical pushing off or hauling in means on the hull side, permits the use thereof in ice-covered shallow waters, particularly those with thick ice covers, without the aforementioned disadvantages occurring. In fact, a substantially ice flow-free channel is formed, the broken floes being moved laterally under the fixed ice cover during the forward propulsion of the ship. As the propulsion of the ship is not brought about by the propellers, there is also no change to the ocean bed. The ship's propulsion takes place solely by lowering one or more piles into the ocean bed and subsequently by mechanical pushing off said piles, the ship being provided with means for driving the travelling piles into the ocean bed and also for hauling them out when the pushing off process is at an end.

Instead of by mechanical pushing off, the ship can also be moved forwards by hauling in using a winch. Thus, there is no suction deduction or wake due to the operation of the propeller, so that there is no rearward movement of cleared ice floes in the aft or stern area into the broken channel. A further advantage results from the use of so-called travelling or migrating piles if, on breaking through compressed ice residues, a propeller-driven ice breaker stops and cannot free itself in the case of sternway travel. In such special situations, the travelling pile permits headway.

Advantageous developments of the invention are characterised in the subclaims, the construction of the travelling piles given in claims 8 to 15 being particularly advantageous in that each pile is constructed in such a way that, using a pressure medium, it can be drawn almost automatically out of the ocean bed following the movement process of the ice breaker in that the pressure medium fed by a supply line in the interior of the pile to the outlet provided in the bed-side top region of the pile on passing out of the outlets at least leads to a loosening of the seating of the pile in the ocean bed, so that the pile can subsequently be drawn out of the same again by suitable lifting gear, but as a function of the characteristics of the ocean bed the pile can be automatically expelled. This action is assisted by the special positioning and arrangement of the outlets for the pressure medium, which are arranged in such a way that the pressure medium jet passing out of the same is directed or the jets from a plurality of outlets arranged in a plane at right angles to the medium longitudinal axis of the pile pass out almost tangentially to the circumferential surface of the latter, so that in the case of jet discharge, the pile performs a rotary movement about its median longitudinal axis and consequently the driven in pile is loosened and consequently high working energy is not required for drawing out the pile by mechanical or hydraulic means.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
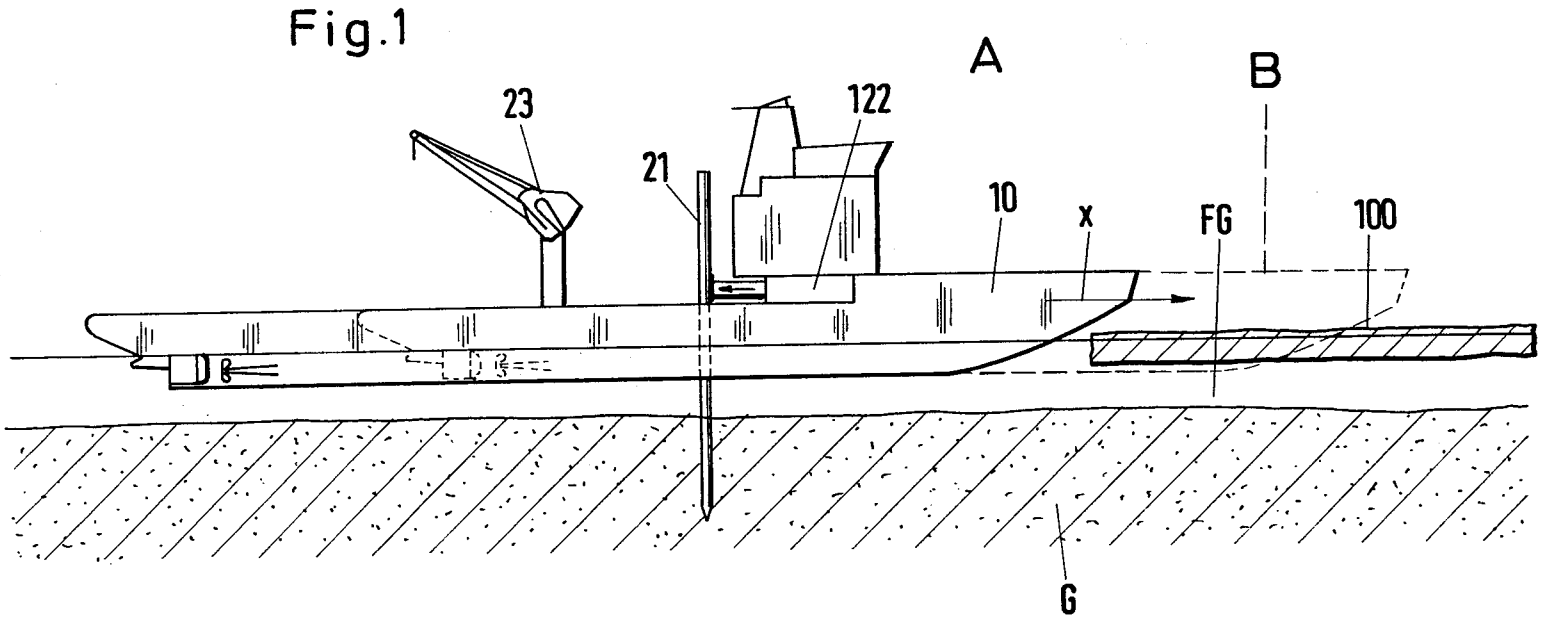
FIG. 1, an ice breaker with a propulsion means operating with the aid of a travelling pile, the propulsion of the ship taking place by pushing off from the pile, in a side view.

In FIGS. 1 to 8, the ice breaker hull is designated 10. This ice breaker is intended for use in ice-covered shallow waters, particularly those having thick ice covers. The shallow water is designated FG in the drawings, the ocean bed as G and the ice cover to be broken is 100.

The horizontal propulsion of the ice breaker takes place by means of mechanical propulsion means 20, are provided on the hull and which permit an instantaneous or constant force closure of the hull 10 with mechanical means located on the ocean bed. These mechanical means comprise in the embodiments shown in FIGS. 1 to 7 of so-called travelling piles 21 placed on ocean bed G and which are lowered into the ocean bed by means 22 provided on the ship, are also hauled out of the same on board the ship. When using travelling piles 21, for the propulsion of the ship there is only an instantaneous force closure of the hull 10 with the pile 21 and namely using pushing off or hauling in means 122 or 24 provided on the ship and to which reference will be made hereinafter.

Figure 8:
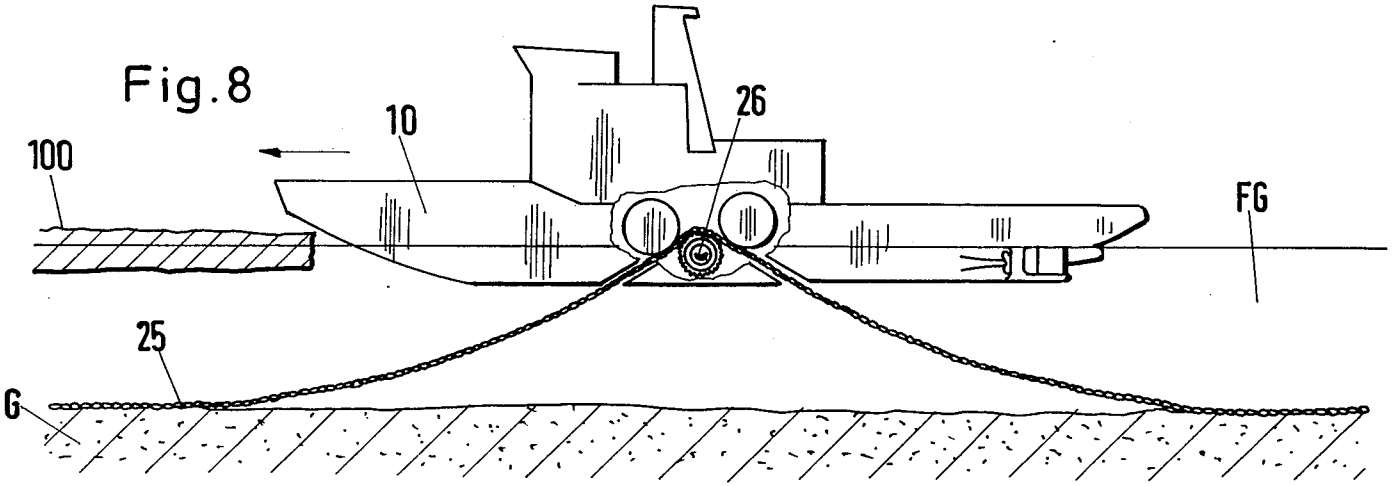
FIG. 8, a side view of another embodiment of an ice breaker hauled on a chain located on the ocean bed.

However, if there is to be a constant force closure between the hull 10 and the mechanical means on the ocean bed, then the latter e.g. comprise a chain 25 which is laid on the ocean bed G where it is secured, i.e. anchored on both sides and which can be in the form of a round steel chain, steel link chain or the like and which is guided by means of correspondingly constructed sprockets 26, which are arranged on the bottom of the hull 10 or within the latter and which are driven by drive means not shown in the drawing (FIG. 8). For this purpose, the hull is provided with corresponding openings for the insertion and removal of the chain, so that the chain does not pass over the deck of the ship. If the sprocket 26 for chain 25 is located in the interior of hull 10, then corresponding openings are provided in the bottom or in the sides of the hull, through which the chain is passed to the outside from sprocket 26, the latter then being arranged in a closed chamber within hull 10, whose bottom or sides receives the openings. Chain 25 can be replaced by a cable. The essential point in the embodiment according to FIG. 8 is that the ice breaker is hauled forward on the chain 25 or cable, which is anchored to the ocean bed and is guided over chain drums located on the ship side. Thus, the propulsion of the ship takes place by drawing along the chain or cable on the ocean bed and the ship can also be horizontally advanced by a chain or cable placed along the ocean bed.

Figure 7:
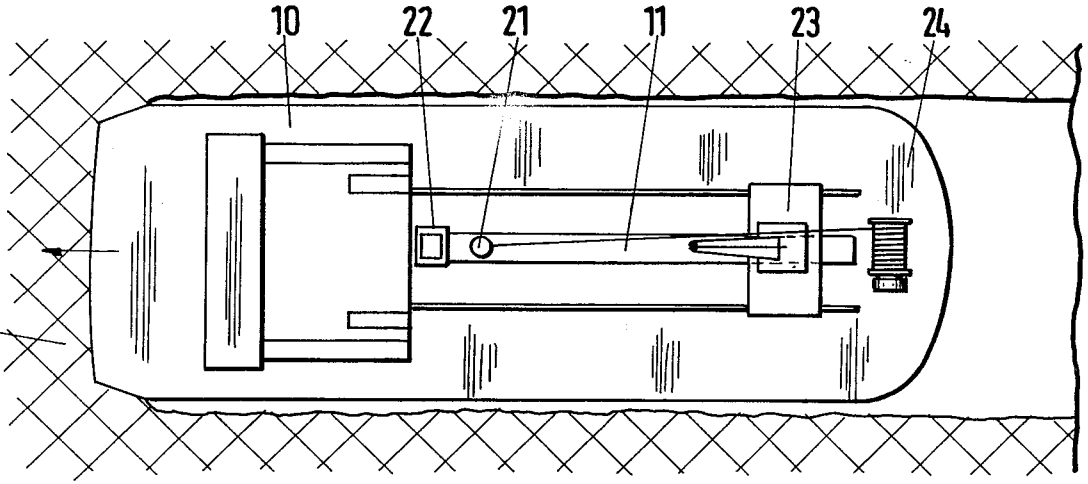
FIG. 7, the ice breaker hull with a traveling pile reception shaft formed in the longitudinal direction of the hull in a view from above.

When using travelling piles, as the pushing off or hauling in means the hull 10 is e.g. provided with a hydraulically or otherwise operated horizontal operating cylinder 122, which is supported on pile 21, after the latter has been lowered into the ocean bed G (FIG. 1). The horizontal propulsion of the ship takes place on operating cylinder 122 in such a way that on extending the piston or ram of the operating cylinder, the latter is supported on the travelling pile 21 and simultaneously the ship is advanced in the direction of arrow x into the unbroken ice cover 100 and breaks the latter. During the forwards propulsion of the ship, the stern moves towards pile 21. FIG. 7 shows a development of hull 10, according to which a slot-like shaft or opening 11 is provided towards the centre and in the longitudinal direction of the ship in the hull and extends from the deck of hull 10 to the bottom of the ship, so that pile 21 can be passed through said slot-like opening As a result of this construction, a free movement of hull 10 is possible during propulsion on the vertical travelling pile 21. However, it is also possible to provided a slot-like shaft for the passage of the travelling piles in the stern only.

Figure 2:
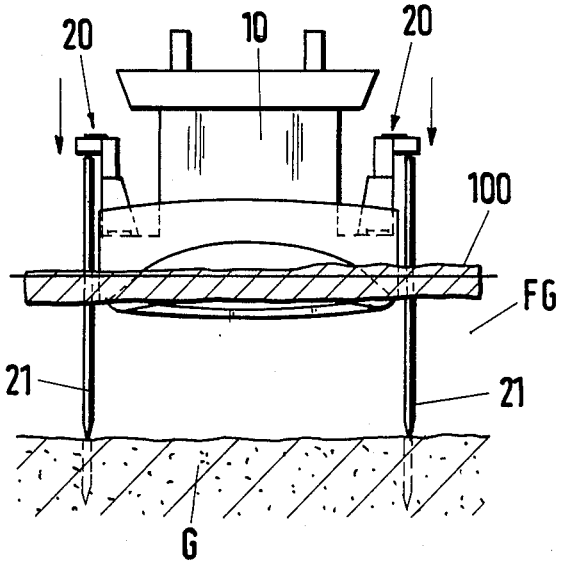
FIG. 2, a front view of another embodiment of an ice breaker with means for driving in and pulling out the travelling piles provided on either side of the hull.
Figure 3:
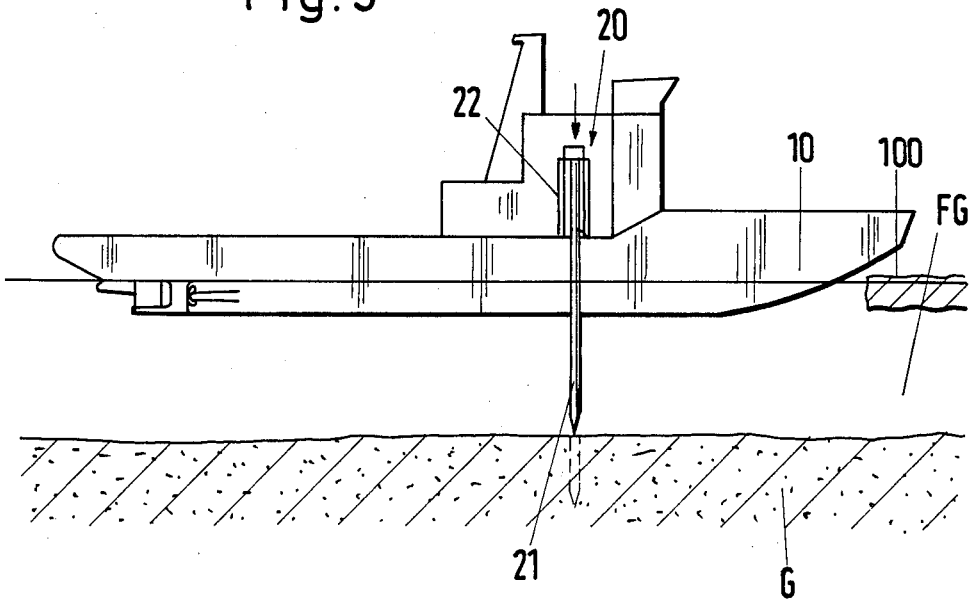
FIG. 3, a side view of the ice breaker according to FIG. 2.
Figure 4:
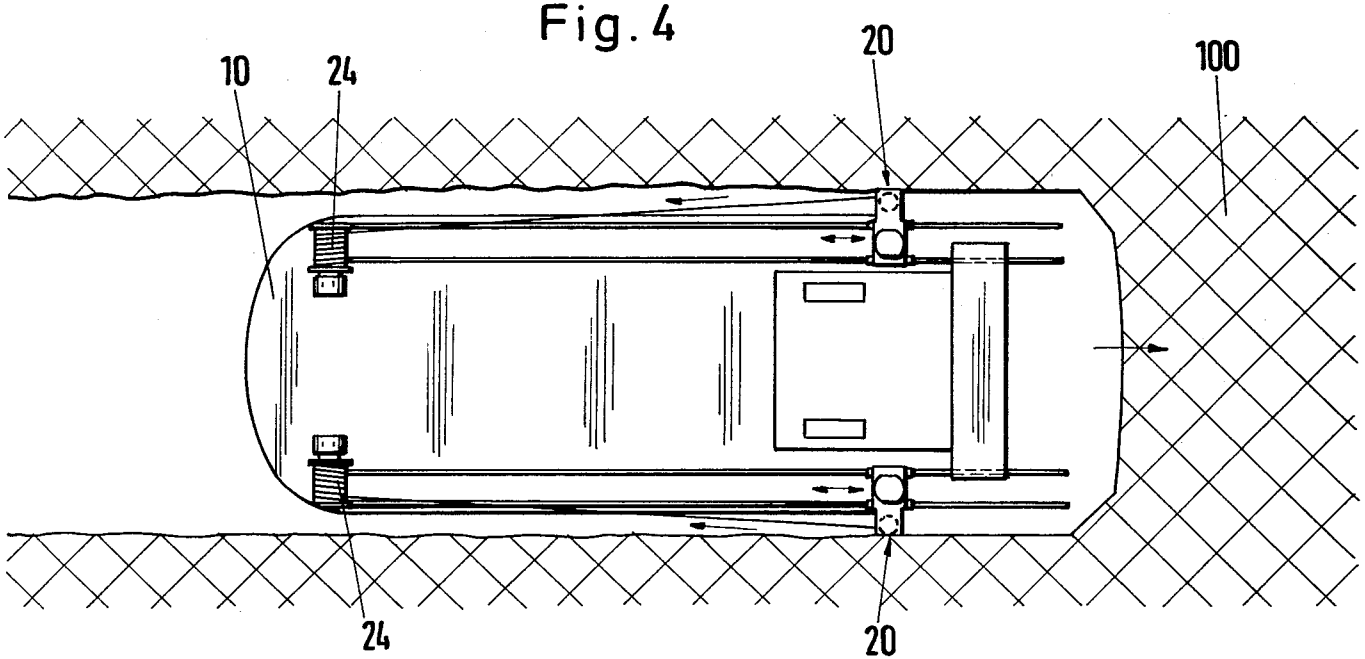
FIG. 4, the ice breaker, but with a hauling in device comprising a cable winch according to FIG. 2 in a view from above.

In the embodiment shown in FIGS. 2, 3 and 4, ship propulsion means 20 are provided on either side of the hull and these are positioned in such a way that the travelling piles 21 can be driven in laterally with respect to the outer skin of hull 10. Thus, the driving in and pulling out of the travelling piles 21 takes place outboard. On the hull side, i.e. particularly on the deck side, pushing off or hauling in means are provided, which are supported on the travelling piles 21 driven into the ocean bed G for the propulsion of the ship. On operating the hydraulic cylinder 122, hull 10 pushes off from the piles 21 driven into the ocean bed and thus receives its propulsion.

When the propulsion of the ship is ended, i.e. if it has moved from position A to position B in FIG. 1, pile 21 is virtually in the stern area of the hull and for initiating a further propulsion process must be drawn out of the ocean bed and driven into it again after transfer to the bow section of the hull. In the meantime, the operating cylinder 122 is moved back into its starting, i.e. retracted position, so that the cylinder can again be supported on the pile driven into the ocean bed. If the operating cylinder is operated, then there is a further propulsion of the hull. Travelling pile 21 is alternately driven into the ocean bed and then removed therefrom at the end of the forward propulsion process and then driven into it again at a new location, so that the ship advances intermittently.

Figure 5:
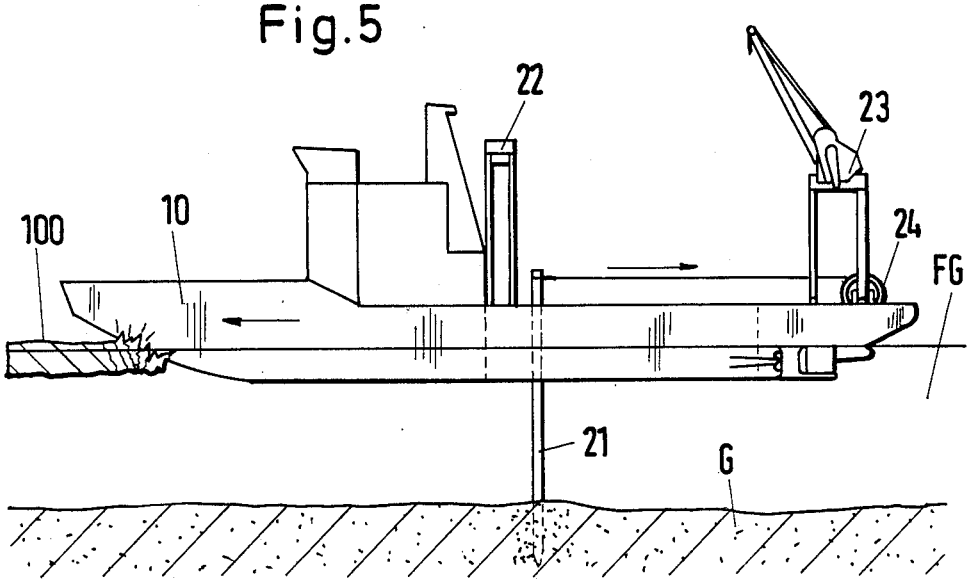
FIG. 5, a side view of an ice breaker with a propulsion means operating through the use of a travelling pile, the propulsion of the ship taking place by hauling in using a cable winch.
Figure 6:
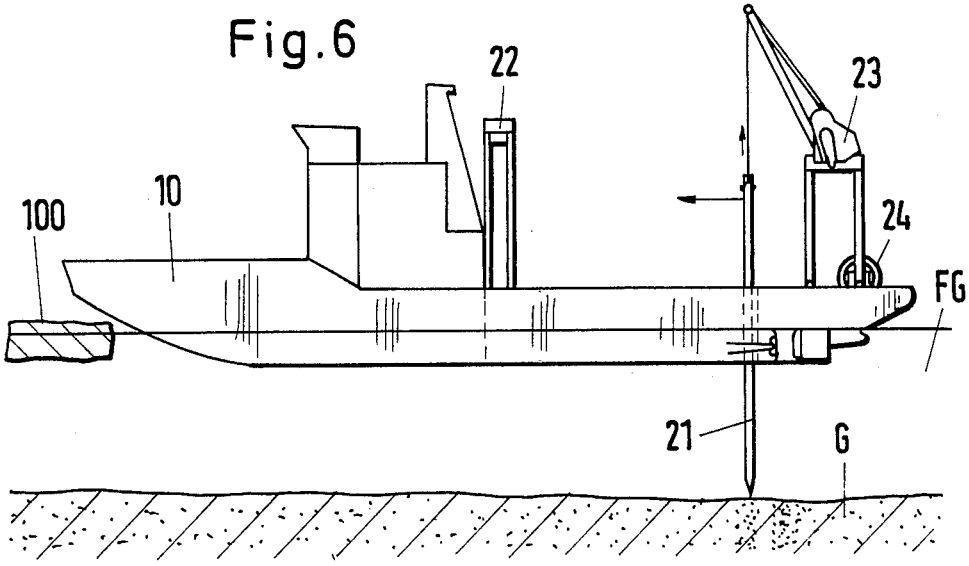
FIG. 6, the ice breaker according to FIG. 5 during the advance of the travelling pile in a side view.

In place of a hydraulic operating cylinder 122 as the pushing off means for the hull on a travelling pile 21, the propulsion of the ship can also take place by hauling in by means of a cable and a cable winch 24, as is represented in the embodiments according to FIGS. 4 to 6. A cable winch 24 is located on the ship, the free end of the cable of said winch being fixed to the travelling pile 21 anchored on the ocean bed G. On operating the winch and drawing the cable onto its drum, then the shortening of the cable length leads to a drawing in of hull 10 on pile 21, which is anchored in the ocean bed in the vicinity of the bow in the initial position for forward propulsion, whilst the winch is located in the stern area. If the hull is moved by means of cable winch 24 into the vicinity of travelling pile 21 (FIG. 6), then pile 21 is drawn out of the ocean bed and prior to again driving in the pile, a movement takes place by means of the same or an identical winch into the starting position and then a further driving of the pile into the ocean bed, as indicated in FIG. 5. In the manner described herein before, there is an alternate anchoring and drawing out of the travelling pile 21 on ocean bed G, so that here again the ship advances intermittently.

The forward propulsion of the ship can be aided by the propellers.

Means 22 for driving in the piles 21 into the ocean bed or for drawing them out of the latter can also comprise hydraulic or otherwise operated working cylinders, it being possible to draw piles 21 out of the ocean bed by means of a crane 23. Crane 23 is movable along the deck in the longitudinal direction of the hull, so that at the end of a propulsion process the pile 21 drawn out of the ocean bed G is transferred to the bow area of the hull, where it can again be lowered. If means 22 are provided on either side of the deck for lowering and hauling up the piles 21, said means can advantageously be combined into a bridge movable along the deck of hull 10.

In place of mechanical pushing off hauling in means, the horizontal propulsion of the ship can also take place by means of known jet or rocket engines.

Besides the mechanical or hydraulic means for drawing out the travelling piles driven into the ocean bed, the loosening and in part also the drawing out thereof can take place by means of a pressure medium.

Figure 9:
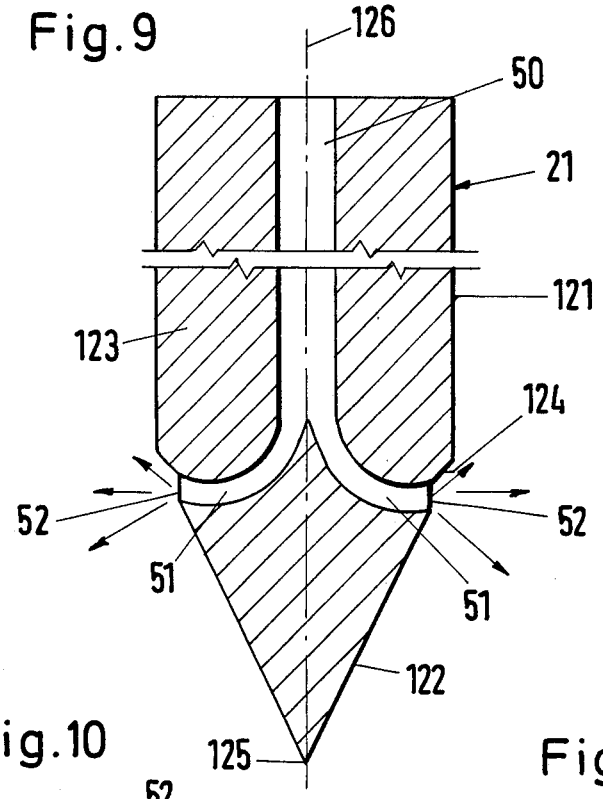
FIG. 9, a travelling pile with a pressure medium supply line issuing into outlets provided in the outer wall of the pile and running in the longitudinal direction thereof in a vertical section.

For this purpose, the travelling pile 21 shown in FIG. 9 is provided with a supply line 50, which is formed in the interior of the pile or which is arranged as a separately constructed line in the interior of the pile 21 constructed as a hollow body. If the travelling pile is constructed as a hollow body, its interior can form the supply line. Supply line 50 runs out into a plurality of channels 51, which issue into outlets 52, located in the outer wall surface 121 of pile 21. By means of supply line 50, outlets 52 are supplied with a pressurized medium, such as e.g. compressed water and/or compressed air or steam.

At the bottom, travelling pile 21 according to FIG. 9 terminates in a conically tapering portion 122. In the transition area between this portion 122 and the actual travelling pile body 123 is provided a retracted portion 124 in which the outlets 52 are located, so that on driving the pile into the ocean bed, said outlets 52 are not made excessively dirty.

Each travelling pile 21 has a plurality of outlets 52, which are connected to supply line 50 and which in the embodiment according to FIG. 9 are radially directed and located in a horizontal plane. However, outlets 52 are constructed, arranged and oriented in such a way, that the outflowing pressure medium jets pass out of the same at right angles to the median longitudinal axis 126 of pile 21, but it is advantageous if the jet outlet directions when leaving the outlets 52 are at an angle of at least 90° to the driving in end 125 of pile 21.

Preferably the outlets 52 are located in portion 122 of travelling pile 21 or in the transition area between portion 122 and pile body 123.

Figure 10:
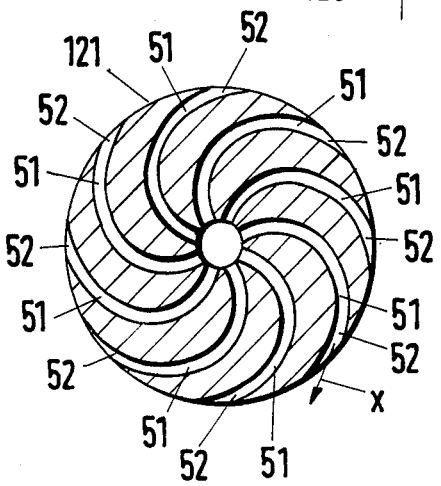
FIG. 10, a travelling pile with outlets for the pressure medium arranged radially in its outer wall with jet outlets located tangentially to said outer wall in a horizontal section.

According to FIG. 10, travelling pile 21 has a plurality of outlet channels 51 in a horizontal plane, whose outlets 52 are also located in the outer wall surface 121 of pile 21. Each outlet channel 51 is arcuate here, so that the ends of the outlet channels permit a roughly tangential discharge of the jets. The outflowing pressure medium imparts a rotary movement to the driven in pile 21, which leads to a loosening thereof in the ocean bed. The travelling pile can have a circular, polygonal or square cross-section. The outlet channels 51, which lead to outlets 52 in the outer wall surface 121 of travelling pile 21, must in any case be oriented in such a way that the outflowing pressure medium jets or the outflowing pressure medium contributes to reducing the frictional forces between pile 21 and the ocean bed, a radial pressure medium outflow also being possible. It is also important that the pressure medium flows out tangentially to the outer wall surface 121 of pile 21 and namely in accordance with arrow X in FIG. 10. The pressure medium outlets 52 consequently form, relative to the pile cross-section at right angles to the longitudinal axis thereof, an angle of less than 90° with its circumferential line.

Figure 11:
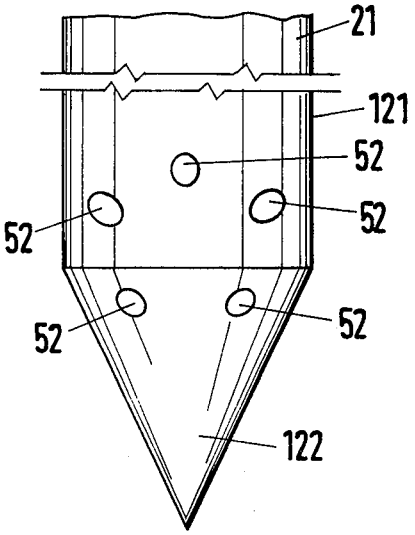
FIG. 11, a side view of a travelling pile with pressure medium outlets juxtaposed and staggered in the outer wall surface thereof.

According to the embodiment shown in FIG. 11, in the base region of the outer wall surface 121 of travelling pile 21 are provided several juxtaposed, superimposed and staggered outlets 52, which are connected via outlet channels with the pressure medium supply line 50.

What is claimed is:

1. An ice breaker, wherein the horizontal propulsion of the ice breaker is independent of a ship screw, the ice breaker including a hull, and wherein the horizontal propulsion of the ice breaker takes place by instantaneous force engagement of the hull with means located on the ocean bed constituted by lowered or lowerable, vertical or sloping travelling piles, mechanical pushing-off or hauling-in means being provided on the hull side, wherein the forward propulsion takes place by hauling-in on the travelling pile using said mechanical means, such as a cable, wherein on the deck of the hull is provided at least one device for driving-in, drawing-out and for position-variable transportation of the travelling piles and which comprises a hydraulic operating cylinder, wherein the drawing-out of the driven-in travelling piles takes place on the hull side by raising the piles by means of a pressurized medium, and wherein in the interior of each travelling pile is provided at least one supply line for the pressurized medium, which is connected to outlets located in the lower region of the outer wall of the pile.

2. An ice breaker according to claim 1, wherein the hull is provided with a central slot-like travelling pile reception opening running in the longitudinal direction of the hull or has a slot-like recess at the stern for receiving the travelling pile.

3. An ice breaker according to claim 1, wherein the bottom of the travelling pile passes out as a conically tapering portion and wherein the outlets for the pressurized medium are located in the conical tip region of the travelling pile.

4. An ice breaker according to claim 1, wherein the bottom of the travelling pile is in the form of a tapering portion, wherein the transition area between a tip region of the pile and the actual pile body is retracted and wherein in said retracted transition portion are located the outlets for the pressurized medium.

5. An ice breaker according to claim 1, wherein the outlets for the pressurized medium are arranged radially and at an angle of at least 90° to the driving in end of the pile.

6. An ice breaker according to claim 1, wherein the outlets for the pressurized medium are located on the outlet-side ends of curved outlet channels at right angles to the longitudinal axis of the travelling pile, relative to the cross-section of the latter.

7. An ice breaker according to claim 1, wherein the outlets for the pressurized medium, relative to the cross-section of the travelling pile and at right angles to the longitudinal axis thereof, form an angle of less than 90° with its circumferential line.

8. An ice breaker according to claim 1, wherein the outlets for the pressure medium are spaced and staggered relative to one another in the outer wall surface of the travelling pile and are connected via outlet channels with the supply line.

* * * * *